United States Patent [19]

Etzel et al.

[11] Patent Number: 4,675,626

[45] Date of Patent: Jun. 23, 1987

[54] CARRIER ASSEMBLY FOR MOUNTING A ROLLED COPLANAR DELAY LINE

[75] Inventors: Stephen J. Etzel, Woodstock, Conn.; Michael M. Gottlieb, Kraainem, Belgium

[73] Assignee: Rogers Corporation, Rogers, Conn.

[21] Appl. No.: 802,478

[22] Filed: Nov. 27, 1985

[51] Int. Cl.[4] ..... H01P 9/00

[52] U.S. Cl. ..... 333/161; 333/23; 174/52 R; 174/52 PE; 361/403; 361/399

[58] Field of Search ..... 333/161, 156, 140, 23; 336/200, 23 R; 174/52 R, 52 H, 52 PE; 361/398-400, 403; 29/602 A, 832, 837, 842

[56] References Cited

U.S. PATENT DOCUMENTS

| | | | |
|---|---|---|---|
| 2,440,652 | 4/1948 | Beverly | 333/156 |
| 3,323,022 | 5/1967 | DaCosta | 174/52 H |
| 3,545,606 | 12/1970 | Bennett | 29/842 X |
| 3,857,993 | 12/1974 | Gregory | 174/52 H |
| 4,050,756 | 9/1977 | Moore | 361/398 X |
| 4,313,095 | 1/1982 | Jean-Frederic | 333/161 X |

FOREIGN PATENT DOCUMENTS

| | | | |
|---|---|---|---|
| 743717 | 1/1956 | United Kingdom | 336/200 |

OTHER PUBLICATIONS

Amaro, J. M. et al; "Integrated Circuit Packaging Structure & Process"; *IBM Technical Disclosure Bulletin;* vol. 18, No. 9; Feb. 1976; p. 2872.

*Primary Examiner*—Eugene R. LaRoche
*Assistant Examiner*—Benny T. Lee
*Attorney, Agent, or Firm*—Fishman & Dionne

[57] ABSTRACT

A mounting or carrying device utilized in conjunction with an electronic component suitable for use on a printed wiring board, the electronic component being capable of adjusting the arrival time of signals in high speed logic systems is presented. Preferably, the electronic component is a time delay line device which is used in conjunction with the mounting or carrying device to form a delay line/carrier assembly for either surface mounting or through hole mounting onto a printed wiring board.

9 Claims, 9 Drawing Figures

CARRIER ASSEMBLY FOR MOUNTING A ROLLED COPLANAR DELAY LINE

BACKGROUND OF THE INVENTION:

This invention relates to the field of electronic signal timing delay devices. More particularly, this invention relates to a new and improved mounting or carrier means utilized in conjunction with an electronic component suitable for use on a printed wiring board and which is capable of adjusting the arrival time of signals in high speed logic systems It is well known in the electronic circuitry art that for a digital network to function correctly, certain logic variables must change state at accurately controlled points in time relative to one another. As a consequence, the precise control of signals is an important concern in printed circuit board (PCB) or wiring board (PWB) design. This concern has become especially critical with the advent of high speed digital logic networks.

Time delay lines are used in the electronics industry to adjust the timing of electronic signals. U.S. patent application Ser. Nos. 760,818 and 761,007, assigned to the assignee hereof, all of the contents of which are incorporated herein by reference, relate to such electronic signal time delay devices. The signal path delay devices of U.S. Ser. Nos. 760,818 and 761,007 are made by forming a laminate of highly conductive metal bonded to a thin, flexible dielectric film. The metal is deposited or etched so as to produce a pattern consisting of a signal line in a ground shield. The signal line is preferably serpentine (i.e., zig-zags) and makes one or more passes back and forth on the dielectric film. A ground plane is also provided via the conductive metal and surrounds the signal line, separated thereby by a small gap on both sides of the line. Two pads or other means are provided at the ends of the signal line to interconnect the same with the circuit in which it is used. This coplanar flexible circuit is then rolled up tightly into a cylindrical shape. Significantly, the serpentine pattern of the signal line must be designed so that when the flexible circuit is rolled up, the signal line will overlap the ground plane of the next layer (not the signal line of the next layer). While there will be some overlap of the signal lines, such overlap should be at right angles and with a minimal break in the ground shield. The rolled circuit should use adhesive to hold it together and to stabilize the effect of the dielectric. Thereafter it may be packaged and marked by number of well known methods.

In U.S. Pat. Ser. No. 761,007, the delay of the delay line is substantially increased (without increasing the line length of the circuit) by utilizing a dielectric and/or adhesive having high permeability. The use of a high permeability dielectric and/or adhesive will minimize the size, cost and resistive losses of the time delay device.

The signal delay device of the prior patent applications has many advantages and features over both currently used delay lines as well as over prior art microstrip flexible circuit delay lines. Accordingly, the signal delay device of U.S. patent application Ser. Nos. 760,818 and 761,007 will provide a standard electronic component to be used on high speed logic boards, which will provide an accurate fixed time delay for high speed electronic signals; this time delay being provided with minimum distortion and degradation of the delayed signal. Additionally, the delay device of the prior application is of compact size and is extremely economical to manufacture in high volume production.

While well suited for its intended purposes, there is a perceived problem with respect to mounting the delay line devices of the prior applications onto a printed wiring board. Typically, the finished delay line product is a small cylindrical piece which must be connected to a printed circuit by means of pads located on the circumference of the part. The usual method of interconnection between a time delay device and a printed wiring board would be reflow soldering. However, a reflow soldering operation would pose a number of difficulties to the prospective user of the delay line including:

(1) It would be difficult to consistently orient the delay line and hold it during a soldering operation so that the contact pads of the delay line correctly line up with the corresponding pads on the printed wiring board; and (2) the present form or configuration of the delay line device would make automatic handling during mounting on a printed wiring board extremely difficult.

SUMMARY OF THE INVENTION

The above discussed and other problems and deficiencies of the prior art are overcome or alleviated by the improved mounting or carrying means of the present invention for use in conjunction with the time delay device such as is described in U.S. patent application Ser. Nos. 760,818 and 761,007. This mounting header or carrier comprises a nonconductive base having a plurality (generally 3) of pins extending therethrough with one end of the pins providing a support for connection to contact pads on the delay line, and the other end of the pins adapted for either through-hole mounting or surface mounting on a printed circuit or wiring board. The generally cylindrical delay line component could be mounted on the carrier base by reflowing a high temperature solder after having aligned the pads on the delay line with the pads on the header base. Thereafter, the delay line device and the carrier means could be encapsulated to provide a hermetically sealed electronic component.

The spacing of the conductive pins through the header base or substrate would correspond with the standard dimensions used on printed wiring boards.

The above-described mounting or carrying means used in conjunction with delay line devices provide many advantages and overcome the deficiencies described above. For example, the encapsulated and mounted delay line device could be easily oriented and held during soldering onto the printed wiring board. Similarly, the mounted delay line device of the present invention will be well suited for use in conjunction with automatic handling equipment for automatically mounting onto printed wiring boards.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
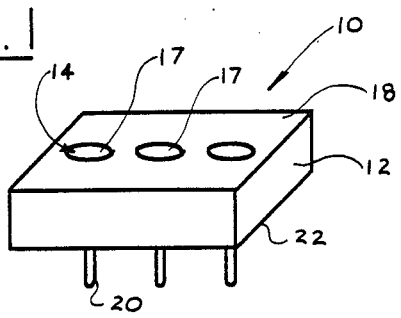
FIG. 1 is a perspective view of a delay line device mounting or carrying means in accordance with the present invention.
Figure 2:
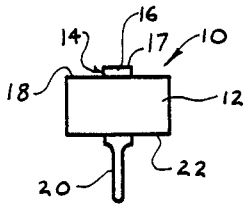
FIG. 2 is an end view along the line 2—2 of FIG. 1 in accordance with the present invention.
Figure 3:
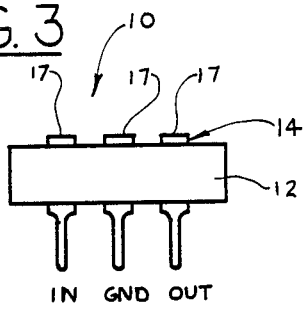
FIG. 3 is a front elevation view along the line 3—3 of FIG. 1.

Referring first to FIGS. 1-3, the carrier means or header device for use in conjunction with time delay devices is shown generally at 10. Carrier means 10 is specifically configured for through hole mounting and comprises a nonconductive base or substrate 12 having a plurality of conductive pins 14 extending therethrough such that the first end 16 of pins 14 extends outwardly from top surface 18 of substrate 12 and a second end 20 of pins 14 extends outwardly from lower surface 22 of substrate 12. Alternatively, first end 16 may be flush with top surface 18. First end 16 has a flattened top surface 17. Typically, nonconductive substrate 12 is comprised of a suitable plastic material while conductive pins 14 are comprised of a a suitable conductive metal. As described in detail in the above-discussed patent application Ser. Nos. 760,818 and 761,007, the delay line devices disclosed therein include three contact areas for electrically connecting IN, OUT and GROUND. Accordingly, carrier means 10 is preferably provided with three conductive pins 14 corresponding to IN, OUT and GROUND (see FIG. 3). Carrier means 10 of FIGS. 1-3 is specifically configured for mounting in through holes on a printed wiring board as will be discussed in greater detail hereinafter (see FIG. 9).

Figure 4:
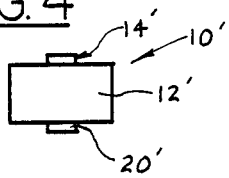
FIG. 4 is an end view of a delay line device mounting or carrying means used in surface mounting applications in accordance with the present invention.
Figure 5:
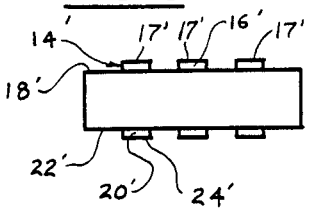
FIG. 5 is a front elevation view of the surface mounted delay line carrying means of FIG. 4.

Turning now to FIGS. 4 and 5, a second embodiment of the carrier means specifically configured for surface mounting on a printed wiring board is shown generally at 10'. Surface mountable carrier means 10' of FIGS. 4 and 5 is substantially similar to through hole mountable carrier means 10 of FIGS. 1-3. The primary difference between the two embodiments of the present invention is that the second end 20' of pins 14' of FIGS. 4 and 5 is adapted for surface mounting on a printed wiring board (see FIG. 8). Thus, the second or lower end 20' of pins 14' will generally have a planar surface 24' for surface mounting onto solder pad positioned on the surface of printed wiring board. Elements 12', 16', 17', 18', and 22' are identical to elements 12, 16, 17, 18, and 22, respectively described hereinabove.

Figure 6:
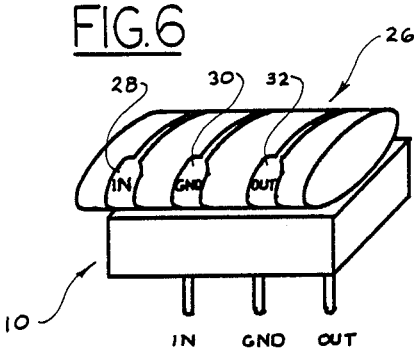
FIG. 6 is a front perspective view of the delay line carrying means of FIG. 1 while a delay line is being mounted thereon in accordance with the present invention.
Figure 7:
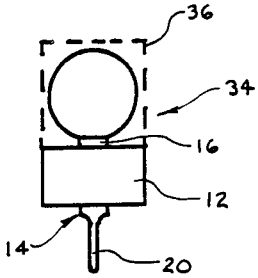
FIG. 7 is an end view of the delay line/carrier means assembly of FIG. 6 showing encapsulation in dashed lines.

In FIG. 6, a time delay line device representative of the delay devices disclosed and claimed in co-pending U.S. patent application Ser. Nos. 760,818 and 761,007 is shown generally at 26. As shown in FIG. 6, the typically cylindrically shaped delay line component 26 having three contact pads 28, 30 and 32 corresponding to IN, GROUND and OUT terminals may be mounted on the corresponding IN, GROUND and OUT conductive pins 14 by reflowing a high temperature solder after having aligned the pads 28, 30 and 32 of delay line device 26 with the corresponding IN, GROUND and OUT pads 17, 17' (see FIGS. 3 and 5) on carrier means 10 (or carrier means 10'). Preferably, the melting temperature of the solder used for this initial mounting operation (mounting delay line device 26 onto carrier means 10), would have to be significantly higher than the melting temperature of the solder used to connect the assembled delay line device/carrier means (identified at 34 in FIG. 7) onto the printed wiring board. After delay line device 26 has been soldered to the respective conductive pins 14 of carrier means 10, the entire assembly may be encapsulated in a suitable low pressure encapsulating material (plastic) so as to provide a completely hermetically sealed, environmentally protected electronic component. Such an encapsulated delay line device/carrier means assembly 34 is shown in FIG. 7 with the encapsulation being identified by the dashed lines 36.

Figure 9:
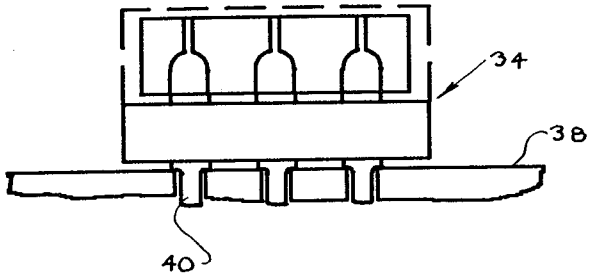
FIG. 9 is a front elevation view of a delay line/carrier means assembly after being through hole mounted on a printed wiring board in accordance with the present invention.
Figure 8:
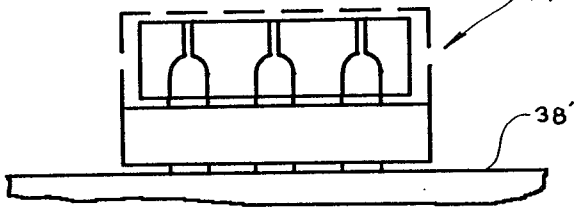
FIG. 8 is a front elevation view of a surface mounted delay line/carrier means assembly in accordance with the present invention.

Turning now to FIGS. 8 and 9, delay line device/carrier means assemblies 34' and 34 are shown respectively both surface mounted onto a printed wiring board 38' (see FIG. 8) and mounted to a printed wiring board 38 via through hole mounting and through holes 40 (see FIG. 9).

The carrier means device for mounting a delay line onto a printed circuit board in accordance with the present invention provides many features and advantages which overcome those deficiencies described above with regard to the delay lines disclosed in U.S. patent application Ser. Nos. 760,818, and 761,007. For example, the delay line/carrier means assembly is far easier to consistently orient and hold in position during a soldering operation onto the pads of the printed wiring board relative to attempting that same operation with the delay line device being directly soldered to the printed wiring board. Also, the encapsulated delay lines/carrier means assembly may be used in conjunction with automatic handling equipment during electronic component mounting onto printed circuit boards while it would be extremely difficult to accomplish such automatic handling with the delay line device alone.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An electronic signal time delay device for use in a circuit pattern comprising:

coplanar flexible circuit means, said flexible circuit means including a nonconductive substrate having first and second opposed surfaces, said substrate including electrically conductive material disposed on one of said opposed surfaces;

said conductive material consisting of a ground plane with a signal line therein, said signal line being separated from said ground plane via a gap on both sides of said signal line;

said coplanar flexible circuit means having a longitudinal dimension and being rolled along said longitudinal dimension; and carrier means, said rolled coplanar flexible circuit means being mechanically and electrically mounted on said carrier means to define a delay line/carrier means assembly, said carrier means comprising;

nonconductive base means having opposed first and second surfaces;

at least three conductive pin means having opposed first and second ends and being positioned through said base means, said first ends communicating with said first opposed surface, said second ends extending outwardly of said second opposed surface, said rolled coplanar flexible circuit means being mounted to said conductive pin means first ends whereby said signal line is electrically connected to two of said pin means and said ground plane is electrically connected to one of said pin means.

2. The device of claim 1 wherein said rolled coplanar flexible circuit means includes conductive contact pads connected to said signal line; and wherein said pin means first ends are electrically attached to said contact pads.

3. The device of claim 1 wherein:

said rolled coplanar flexible circuit means includes three contact pads defining in, out and ground terminals, respectively; and wherein said carrier means includes three conductive pin means corresponding to said in, out and ground contact pads of said delay line.

4. The device of claim 1 including:

insulative material encapsulating at least a portion of said delay line/carrier means assembly to define a hermetically sealed delay line/carrier means assembly.

5. The device of claim 1 wherein:

said pin means second ends are adapted to mount onto the surface of a printed wiring board.

6. The device of claim 5 wherein each of said pin means second ends include a planar base portion.

7. The device of claim 1 wherein:

said pin means second ends are adapted to be through-hole mounted onto a printed wiring board.

8. The device of claim 1 wherein:

said pin means first ends are substantially flush with said first surface.

9. The device of claim 1 wherein:

said pin means first ends extend outwardly of said first surface.

* * * * *